United States Patent [19]

Norton

[11] 4,181,048

[45] Jan. 1, 1980

[54] FLANGE TURNING TOOL

[76] Inventor: Ralph L. Norton, 2443 Agostino Dr., Rowland Heights, Calif. 91478

[21] Appl. No.: 909,837

[22] Filed: May 26, 1978

Related U.S. Application Data

[63] Continuation of Ser. No. 721,893, Sep. 9, 1976, abandoned.

[51] Int. Cl.[2] ..... B25B 13/02

[52] U.S. Cl. ..... 81/90 C

[58] Field of Search ..... 81/90 B, 90 C

[56] References Cited

U.S. PATENT DOCUMENTS

| | | | |
|---|---|---|---|
| 2,982,162 | 5/1961 | Golden | 81/90 B |
| 3,230,783 | 1/1966 | Anderson | 81/90 B X |
| 3,721,137 | 3/1973 | Mosher | 81/90 B |
| 3,897,701 | 8/1975 | Daniels et al. | 81/90 C X |

*Primary Examiner*—James G. Smith
*Attorney, Agent, or Firm*—Boniard I. Brown

[57] ABSTRACT

A flange turning tool adapted for use with flanged pipe couplings, wherein the wrench comprises a head member having a reduced, extending, jaw member which is provided with a cylindrical key pin that extends laterally and outwardly therefrom. The key pin is arranged to be received in any one of a plurality of openings located about the flange member of the pipe coupling. The annular periphery of a thrust flange will engage the shoulder defined by the rear enlarged portion of the head member. The head member has a threaded bore to receive a conventional bar or extension handle. When force is applied to the bar, the flange is locked between the key pin and shoulder and is then either tightened or untightened, depending on the direction of force applied thereto.

4 Claims, 3 Drawing Figures

FLANGE TURNING TOOL

This is a continuation, of application Ser. No. 721,893, filed Sept. 9, 1976 now abandoned.

BACKGROUND OF THE INVENTION

1. Field of the Invention

This invention relates generally to a spanner-type wrench, and more particularly to a flange turning tool, the pipe coupling being of the type having an annular flange member provided with a plurality of spaced apart holes therein.

2. Description of the Prior Art

As is well known in the art, various problems and difficulties are encountered in providing suitable means for mounting flanged pipe couplings to the ends of pipes sections or on equipment to which a pipe section is connected.

The conventional, widely-used means for threading such flanged couplings to the threaded pipe ends comprises two bolts inserted into spaced bolt holes disposed in the flange, wherein a bar is applied between the two bolts and force is then exerted, providing a turning force to the coupling. The bolts must be moved to successive positions during the turning operation, because the pipe and other related objects interfere during a full rotation about the pipe. Thus, considerable time and labor are involved in this rather awkward operation.

At present there is a need for a simple tool that will allow the coupling to be mounted in the simplest manner and shortest time period.

SUMMARY OF THE INVENTION

The present invention comprises a spanner-type wrench tool that is specifically designed to be employed with flanged pipe couplings. These well known couplings are defined by a central, internally threaded body having a laterally extending annular flange provided with a plurality of equally spaced bolt holes disposed therein.

The present invention comprises a head member having a reduced, thickened, extended jaw member at one end thereof and an internally threaded bore disposed at the opposite end thereof. The jaw member is provided with a cylindrical key pin which is adapted to be received in any one of the holes in the flanged member of the coupling. The peripheral edge surface of the flange is positioned between the key pin and a thrust shoulder formed by the enlarged area of the head member.

Accordingly, the threaded bore of the head member is arranged to receive a bar or extended threaded handle, whereby force can be applied to the pipe coupling in either a tightening or an untightening direction by the seating of the shoulder and the binding of the flange between the key pin and the shoulder of the head member.

The present invention has for an important object a means whereby flanged pipe couplings can be mounted by a spanner-type wrench without interference from the pipe and other related objects.

It is another object of the invention to provide a flange turning tool that can be adapted with various sized bars or handles.

It is still another object of the invention to provide a flange turning tool which is economical to fabricate.

It is a further object of the present invention to provide a tool of this character that saves considerable time and labor.

It is still a further object of the invention to provide a tool of this character that is simple and rugged in construction.

The characteristics and advantages of the invention are further sufficiently referred to in connection with the accompanying drawings, which represent one embodiment. After considering this example, skilled persons will understand that variations may be made without departing from the principles disclosed herein and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
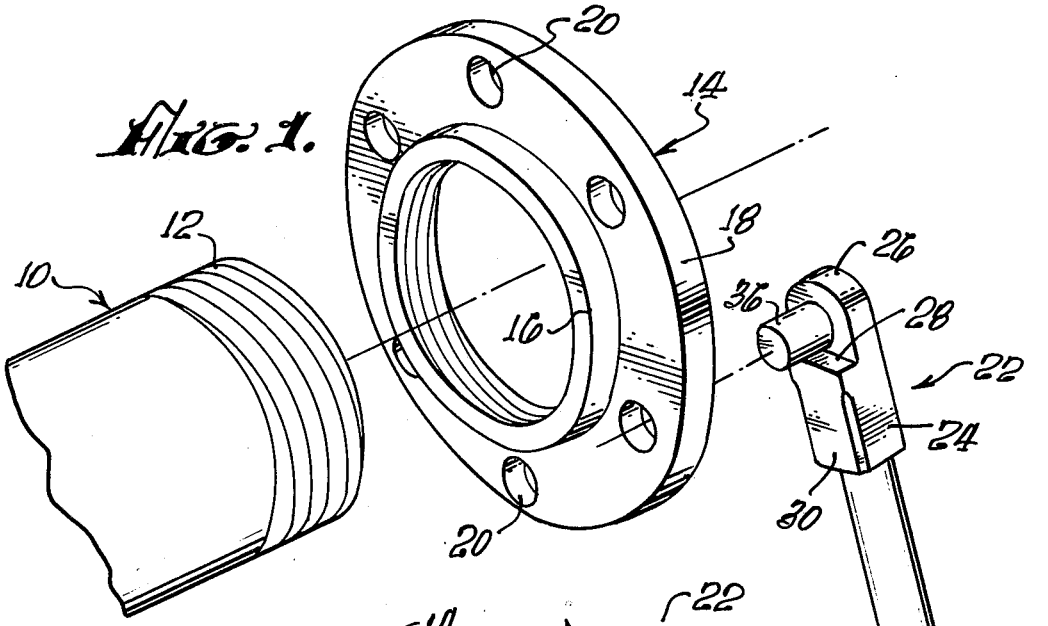
FIG. 1 is an exploded view showing the threaded end of a pipe, the flanged coupling, and the present invention just prior to being received in one of the holes disposed in the flange.

Referring more particularly to FIG. 1, there is shown a typical pipe, generally indicated at 10, having the end thereof threaded at 12. The threads 12 are arranged to receive the flanged pipe coupling, designated at 14, which has an internally threaded neck member 16 and a laterally-disposed, annular flange member 18. Positioned about the body of the flange 18 are a plurality of bolt holes 20 through which the coupling can be mounted or connected to other related equipment.

However, these holes provide a means for the flange turning tool to directly engage the coupling.

Accordingly, the pipe coupling spanner wrench, indicated generally at 22, comprises a head member 24 having a forwardly extending jaw member 26, said jaw member being reduced in thickness so as to provide a transverse, flat-surfaced thrust shoulder 28 formed by the enlarged rear body 30. Thus, a recess 31 is established by the jaw surface 33 and the transverse shoulder 28. Said enlarged rear body is provided with a longitudinal bore 32 which is internally threaded at 34.

Threaded bore 32 is arranged to receive any standard type handle or extended bar 35 having matching external threads.

Figure 2:
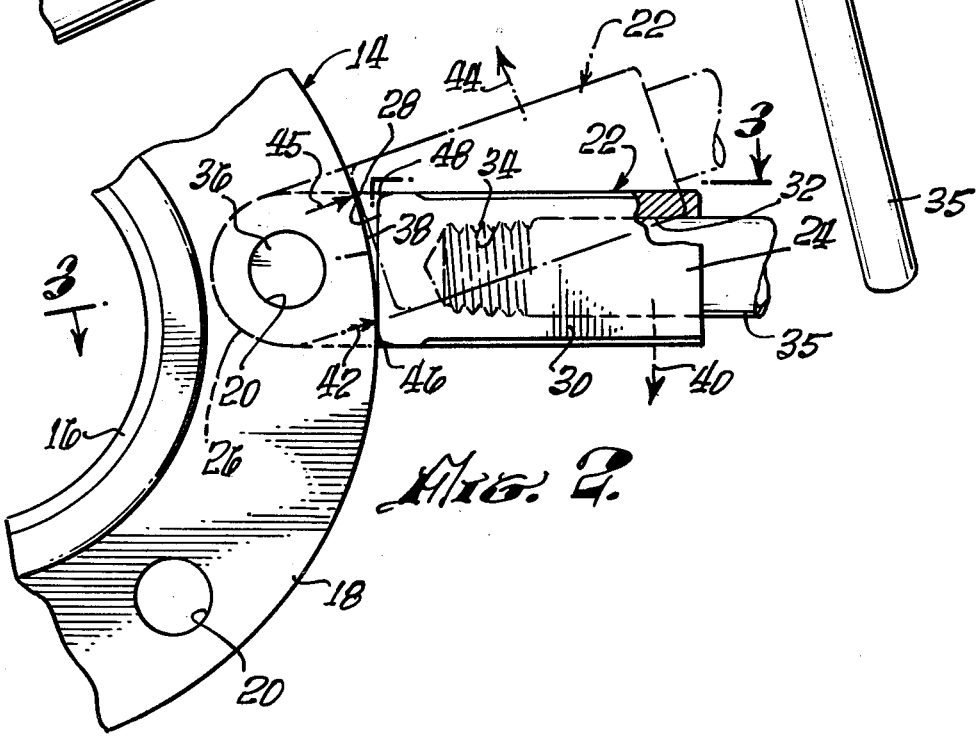
FIG. 2 is a plan view illustrating the flange turning tool engaging the coupling flange.
Figure 3:
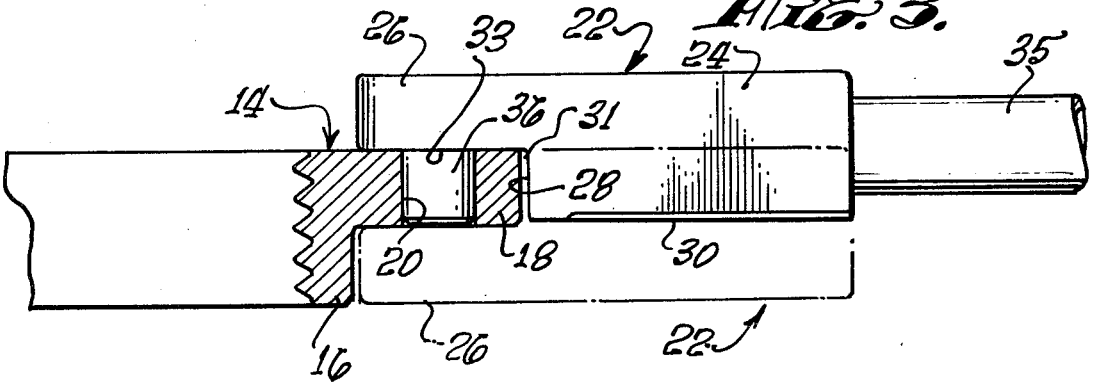
FIG. 3 is an enlarged cross-sectional view taken substantially along line 3—3 of FIG. 2.

The forward jaw member 26 includes a cylindrical key pin 36 integral therewith in a laterally extending manner, so as to be received within any one of said bolt holes as seen in FIGS. 2 and 3. As the key pin 36 is inserted in hole 20, the outer periphery 38 is interdisposed between the pin and shoulder 28.

Thus, as leverage or force is applied to the wrench through handle 35, such as to untighten the coupling as indicated by arrow 40, the shoulder 28 at the point 42 abuts the flange periphery 38, causing a locking engagement between the thrust shoulder 28 and key pin 36. This then will rotate the coupling.

When the coupling is to be tightened, the force is applied in the direction of arrow 44 and the binding action takes place at point 45, as seen in FIG. 2.

Due to the variance of the width of some coupling flanges, it is contemplated that corners 46 and 48 will be rounded to eliminate possible damage to the peripheral edge of small diameter flanges.

The invention and its attendant advantages will be understood from the foregoing description and it will be apparent that various changes may be made in the form, construction and arrangement of the parts of the invention without departing from the spirit and scope thereof or sacrificing its material advantages, the arrangement hereinbefore described being merely by way of example, and I do not wish to be restricted to the specific form shown or uses mentioned, except as defined in the accompanying claims.

The inventor claims:

1. A tool for turning a flange having a central axis, a peripheral surface and at least one axially extending opening, said flange turning tool comprising:

a body portion, a pin extending outwardly from a recessed surface of said body portion adapted to engage in one of said flange openings, a thrust shoulder on the body portion confronting and spaced from the pin to define recess means for receiving a portion of the flange extending between the opening and the periphery, and handle means extending from said body portion for rotating the tool.

2. A tool for turning a flange having a central axis, a peripheral surface and at least one axially extending opening, said flange turning tool comprising:

a body portion, a cylindrical pin extending outwardly from a recessed surface of said body portion and sized to be received in one of the flange openings, means defining a thrust shoulder on the body portion confronting the pin and spaced therefrom to define a recess means for receiving a portion of the flange extending between the opening and the periphery, whereby the shoulder abuts the flange periphery when the pin is engaged in one of the openings for application of force thereto for turning the flange, and handle means extending from said body portion for application of the turning force.

3. A flange turning tool according to claim 2, wherein:

a reduced portion of the tool is defined by and extends beyond the thrust shoulder to define a jaw portion, and wherein said pin extends outwardly from the jaw portion.

4. A flange turning tool according to claim 2, wherein:

the handle means comprises an extension handle removably secured in a threaded opening in the body portion.

* * * * *